US010487540B2

(12) United States Patent
Serafini et al.

(10) Patent No.: US 10,487,540 B2
(45) Date of Patent: Nov. 26, 2019

(54) PROGRAMMABLE LOCKING CYLINDER

(71) Applicant: Dormakaba Schweiz AG, Wetzikon (CH)

(72) Inventors: Renato Serafini, Hombrechtikon (CH); Peter Hertlein, Melk (AT); Stefan Böes, Zürich (CH); Stephan Cecil Fox, Zürich (CH); Moritz Mussgnug, Zürich (CH); Daniel Alexander Türk, Zürich (CH); Mirko Meboldt, Zürich (CH); Benjamin Gugerli, Wetzikon ZH (CH); Urs Späni, Schindellegi (CH)

(73) Assignee: DORIMAKABA SCHWEIZ AG, Wetzikon (CH)

( * ) Notice: Subject to any disclaimer, the term of this patent is extended or adjusted under 35 U.S.C. 154(b) by 36 days.

(21) Appl. No.: 15/556,723

(22) PCT Filed: Mar. 9, 2016

(86) PCT No.: PCT/CH2016/000044
§ 371 (c)(1),
(2) Date: Sep. 8, 2017

(87) PCT Pub. No.: WO2016/141496
PCT Pub. Date: Sep. 15, 2016

(65) Prior Publication Data

US 2018/0058100 A1 Mar. 1, 2018

(30) Foreign Application Priority Data

Mar. 9, 2015 (CH) ..... 321/15

(51) Int. Cl.
*E05B 27/00* (2006.01)

(52) U.S. Cl.
CPC ..... *E05B 27/005* (2013.01)

(58) Field of Classification Search
CPC ..... E05B 27/005; E05B 27/0021; E05B 27/0053; E05B 27/0082
(Continued)

(56) References Cited

U.S. PATENT DOCUMENTS 2,232,017 A 2/1941 Wilder
2,232,137 A * 2/1941 Rolph ..... E05B 27/005 70/378
(Continued)

FOREIGN PATENT DOCUMENTS

EP 2 152 986 10/2011
JP 2007-247336 * 9/2007
(Continued)

OTHER PUBLICATIONS

English translation of International Preliminary Report on Patentability dated Sep. 12, 2017 (dated Sep. 12, 2017), Application No. PCT/CH2016/000044, 6 pages.

*Primary Examiner* — Lloyd A Gall
(74) *Attorney, Agent, or Firm* — Rankin, Hill & Clark LLP

(57) ABSTRACT

The locking cylinder has a stator and a rotor, which can rotate in the stator and has a key opening into which a key can be inserted. The locking cylinder has a multiplicity of tumbler-mating-tumbler pairs, wherein each of the tumblers has a first part and a second part that are connected to one another, for example, with a press fit. In the method for programming a locking cylinder, the locking cylinder has at least one two-part tumbler, having parts that are connected to one another with a press fit. In the method, when a key is introduced into the key opening a length, effective in terms of locking, of the tumbler is changed by the first part and the
(Continued)

second part sliding one into the other or moving apart from one another, in particular is reduced by them sliding one into the other.

21 Claims, 8 Drawing Sheets

(58) Field of Classification Search
USPC ..... 70/358, 359, 491–496, 382–385, 70/337–343, 419, 421, 376–378, 392, 70/DIG. 22, DIG. 29, DIG. 44, DIG. 75
See application file for complete search history.

(56) References Cited

U.S. PATENT DOCUMENTS

| | | | | |
|---|---|---|---|---|
| 3,175,379 | A * | 3/1965 | Russell | E05B 27/005 70/378 |
| 3,190,093 | A | 6/1965 | Schlage | |
| 3,320,781 | A * | 5/1967 | Hill | E05B 27/005 70/378 |
| 3,589,153 | A * | 6/1971 | Hill | E05B 27/005 70/378 |
| 3,667,262 | A * | 6/1972 | Hill | E05B 27/00 70/341 |
| 5,187,957 | A * | 2/1993 | Yang | E05B 35/006 70/378 |
| 5,233,850 | A * | 8/1993 | Schroeder | E05B 27/005 70/337 |
| 7,162,901 | B2 * | 1/2007 | Williams | E05B 27/00 70/358 |
| 8,096,155 | B2 * | 1/2012 | Williams | E05B 27/00 70/358 |
| 2003/0084692 | A1 | 5/2003 | Herdman | |
| 2005/0172687 | A1 * | 8/2005 | Segien | E05B 27/0021 70/493 |
| 2005/0217331 | A1 | 10/2005 | Williams | |
| 2009/0277240 | A1 | 11/2009 | Huang et al. | |
| 2012/0090364 | A1 * | 4/2012 | Sloth | E05B 27/0014 70/355 |
| 2016/0017637 | A1 * | 1/2016 | Widen | E05B 19/0023 70/358 |
| 2016/0362912 | A1 * | 12/2016 | Nicoara | E05B 27/0021 |

FOREIGN PATENT DOCUMENTS

| | | | |
|---|---|---|---|
| WO | 2004/079134 | | 9/2004 |
| WO | 2007/050511 | | 5/2007 |
| WO | WO2007/050511 | A2 * | 5/2007 |
| WO | WO2008/156664 | A2 * | 12/2008 |
| WO | 2010/103032 | | 9/2010 |
| WO | 2014/148994 | | 9/2014 |

* cited by examiner

PROGRAMMABLE LOCKING CYLINDER

BACKGROUND OF THE INVENTION

Field of the Invention

The invention relates to a locking cylinder, in particular to a programmable locking cylinder, as well as to a method for programming a locking cylinder.

Description of Related Art

Locking cylinders include a stator (sometimes also called "cylinder housing"), which is non-rotatably fastened to a lock, and a rotor (sometimes termed "cylinder core"), which is rotatable about the axis of the locking cylinder on inserting a matching key. Drive means that serve for the actuation of a bar or of another means that is related to the desired function of the locking cylinder are moved by way of the rotation of the rotor.

Many mechanical locking cylinders, be they for reversible keys or for serrated keys, for some time now have been based on the same functioning principle. Here, the rotor is a cylinder, which is inserted into the stator and which has several bores, the bores extending through the rotor and the stator and into which a tumbler, a counter-tumbler and a helical spring are inserted in each case. The tumbler and counter-tumbler are movable along the bore axis and are subjected to a restoring force by way of the helical spring. If a key that matches the locking cylinder is inserted into the locking cylinder, then the tumblers position themselves such that a separating gap (i.e. generally the separating surface, separating line or separating location), which is formed between the tumbler the counter-tumbler, coincides with a separating gap (i.e. the separating surface/shear surface) between the rotor and stator. The tumbler comes to lie completely in the rotor and the counter-tumbler completely in the stator. This permits a rotation of the rotor within the stator and can thus permit an unlocking of the locking system.

Locking cylinders are typically manufactured in an individualised manner, so that each of the tumblers has a length that is matched to the associated key. The lengths correspond to the coding, which is incorporated in the key and which manifests itself in recesses of differently large depths at defined (and traced by the respective tumbler) positions on the key. This entails a large effort for logistics having to be made in order to transport the produced locking cylinders to the location of their application or to dealers, particularly if the locking cylinder is to replace another locking cylinder or is to be part of a larger locking system. Moreover, a great amount of manual work for the assembly of the multitude of individual parts is mostly necessary when producing individualised locking cylinders.

Different possibilities with regard to how a locking cylinder can be programmed, thus individualised at a later stage, thus after the assembly, have therefore already been suggested. In the case of programmable locking cylinders, a generic, thus not yet individualized, still programmable locking cylinder can be manufactured, which permits a more efficient and highly automated production. Moreover, generic locking cylinders, which are not programmed until afterwards, for example at the location of application or at a dealer, can be delivered For example, in WO 2010/103032 A1 it is suggested to provide tumblers, whose length can be adjusted by way of a part of the tumbler, which is provided with an inner thread being rotated with respect to a part of the tumbler that is provided with a matching outer thread. It is particularly with reversible key locking cylinders that this necessitates the creation of very small threads. Moreover, one must ensure that the length of each tumbler is adjusted to an adequately precise extent on programming and that this adjustment is still sufficiently accurate even after many years of use.

Further programmable locking cylinders are known, for example, from EP 2 152 986, WO 2007/050511 A2 and US 2003/0084692 A1.

U.S. Pat. No. 3,190,093 shows a locking system for serrated keys, with which the locking cylinder is firstly programmed for a temporary key. The locking cylinder at one position includes a special tumbler-counter-tumbler pair, concerning which the tumbler includes a sleeve and a further element, for example a ball, which is insertable into the sleeve counter to a friction force. This further element is rounded towards the separating gap with the counter-tumbler. If a secondary key with a less deep notch at the location of the special tumbler-counter-tumbler pair is used, then the cylinder blocks on account of the tumbler, which per se is too long. However, the user can push the further element further into the sleeve counter to the friction force by way of rotating amid a corresponding application of force and thus shorten the tumbler as a whole to such an extent that it is matched to the secondary key. The temporary key then no longer fits.

This reprogramming system firstly has the disadvantage that only a very restricted reprogramming is possible and this being in only one direction (from a key with a deeper notch towards a key with less deep a notch). For this reason, the system is also not suitable for the concept of firstly manufacturing a generic, unprogrammed cylinder and not programming it until later, for example on location. Moreover, it is a very delicate task to dimension the force (exerted by a shear movement), which is necessary for pushing the further element into the sleeve, such that on the one hand it is not allowed to become too large, without on the other the connection between the sleeve and the further element becoming loose.

SUMMARY OF THE INVENTION

It is an object of the invention to provide an alternative, programmable locking cylinder which overcomes the disadvantages of the state of the art. In particular, the programming should be able to be effected in a simple and/or rapid and reliable manner. A corresponding method for programming a locking cylinder is also to be provided.

A further object of the invention is to provide a programmable locking cylinder that is mechanically robust, in particular such that the programming is still precise even after years of use and/or after other mechanical loading. A further object of the invention is to permit a particularly simple programming of a locking cylinder. Yet a further object of the invention is to permit a particularly rapid and/or particularly precise programming of a locking cylinder. The programmable locking cylinder and/or or aids that are used for the programming should preferably be comparatively simple to manufacture and meet high security specifications.

A locking cylinder of the type described here is a mechanical locking cylinder (which does not exclude the additional presence of electronic/electromechanical security features) and includes a stator and a rotor, which is rotatable in the stator and which has a key opening, into which a key can be inserted. It further includes a plurality of tumbler-counter-tumbler pairs, which are mounted in bores in the stator and rotor respectively, wherein the respective bores of the rotor and of the stator are aligned with one another when the rotor is located relative to the stator in an initial position, in which an insertion and removal of a key is possible.

According to a first aspect of the invention, one suggests providing a tumbler, which includes two parts, whose relative position can be adapted and fixed, in particular by way of both parts being connected to one another in a press fit.

Furthermore, a locking cylinder according to the first aspect is designed such that it is programmable by way of a tool, which exerts a push force upon the counter-tumbler or directly upon the tumbler, in order to push the two parts of the tumbler (further) into one another, whilst a key with the desired coding is introduced into the cylinder and forms an inner-side stop (stop at the inner side) for the respective tumbler, the stop being dependent on the coding.

In contrast to the state of the art, according to the first aspect, the programming of the mechanical locking cylinder is therefore effected by an interaction between on the one hand a tool, which presses the tumbler (directly or via the counter tumbler) inwards up to a certain position, and on the other hand the premanufactured key, which has the correct coding.

For this purpose, the locking cylinder according to the first aspect includes an access for the tool, through which access the tool, for example in the finished assembled condition of the locking cylinder (in which a spring presses inwards the respective counter-tumbler), can act upon the counter-tumbler or tumbler. Such an access for example is an access opening per tumbler-counter-tumbler pair with a programmable (length-adjustable) tumbler.

For example, a generic (programmable) locking cylinder can be manufactured, in which tumblers, counter-tumblers and springs are already assembled and the stator is encased e.g. by a sleeve or another housing. Here, the two parts of the tumblers are connected to one another (in particular in a press fit) such that tumblers all have at least such a length as is maximally required for an arbitrary key, for which the locking cylinder is to be programmable.

If one then inserts a key, for which the locking cylinder is to be programmed, then the tumblers only yet need to be shortened to such that extent (by inserting the two parts into one another) that the separating gap between the tumblers and counter-tumblers coincides with the separating gap between the rotor and the stator, for all tumbler-counter-tumbler pairs. The rotor is then rotatable within the stator, and the tumblers have precisely the length required for this. In order to have indeed achieved precisely the correct tumbler length at the end of the insertion of the two parts into one another, for the programming it is possible to use a simple tool, which is with a stud (or rod) and which is pushed e.g. along the bore axis for the tumbler counter-tumbler pair into the stator (and possibly also through a sleeve or another housing), in order to then exert a pushing force upon the counter-tumbler or directly upon the tumbler, by way of which force the two parts of the tumbler are inserted (further) into one another.

Here, the tool can include a mechanical stop that prevents a further insertion of the stud into the locking cylinder precisely when the desired position (separating gap between the tumbler and counter-tumbler coincides with the separating gap between the rotor and stator) is reached. As simple tool (for example with a plurality of equally long studs) can be sufficient for all tumbler-counter-tumbler pairs, depending on the complexity of the locking cylinder, by way of which tool all tumbler-counter-tumbler pairs of the locking cylinder are simultaneously or sequentially programmable, for example row after row. Alternatively, different tools are possibly required for different tumbler-counter-tumbler pairs.

Basically, it is also conceivable for the parts of the tumblers (in particular those situated in a press fit) to be moved apart (in particular pulled apart), so that the length of the tumblers is increased on programming (wherein the parts are subsequently still of course connected one another in the press fit). Hereinafter, it is only the variant of pushing-together/reducing the tumbler length, which is dealt with, since the mechanical realisation of a (further) pushing-together of the two tumbler constituents appears to be simpler that a moving-apart/pulling-apart.

A programmable locking cylinder can be created by way of this, wherein it is possible for this to be programmable in a particularly simple manner.

Of course, one does not rule out the locking cylinder, additionally to the mentioned tumbler counter-tumble pairs with (at least) two-part tumblers, being able to include yet further tumbler-counter-tumbler pairs, for example with common, single-part tumblers.

In an embodiment, a locking-effective length of each of the tumblers can be reduced by way of pushing the respective first and second part into one another.

The locking-effective length is the length that the tumbler measures along a bore axis which defines the bore in the rotor, in which bore the tumbler is mounted (in this text, the term "bore" is used independently of how the respective structures (holes/cavities/openings) are manufactured, i.e. it is not restricted to a manufacture by way of drilling).

The counter-tumbler that is used in combination with the tumbler, which is length-adaptable by way of the adaptable relative position of the first and second part, in embodiments can be a conventional, single-part counter-tumbler. In particular, such is sufficient for locking systems with at the most medium security specifications.

However, with locking systems with high security specifications, it is necessary for the sum of the locking-effective length of the tumbler and counter-tumbler to be constant, so that the tumbler length cannot be read out with the help of measuring instruments.

In order to create this possibility, according to a second aspect of the invention, a (mechanical) locking cylinder—for example according to the first aspect—is provided, which likewise includes a stator and a rotor that is rotatable in the stator and which is with a key opening, into which a key can be inserted. It moreover includes a plurality of tumbler-counter-tumbler pairs, which are mounted in bores in the rotor and stator respectively, wherein the respective bores of the rotor and of the stator are aligned with one another when the rotor is located relative to the stator in an initial position, in which an insertion and removal of a key is possible. According to the second aspect, at least one of the tumblers includes a first and a second part, which can be brought into different positions relative to one another and fixed in these, and at least the associated counter-tumbler includes a third and fourth part, which can be brought into different positions relative to one another and fixed in these, wherein a locking-effective total length of the tumbler along an axis is dependent on the relative position of the first and of the second part and a locking-effective total length of the counter-tumbler along an axis is dependent on the relative position of the third and fourth part.

According to the second aspect therefore, the tumbler as well as the counter-tumbler is adjustable in is locking-effective length.

In particular, the first, second, third and fourth parts can be shaped and arranged relative to one another in the initial position of the rotor relative to the stator such that a movement of the fourth part relative to the third part by a path length L effects a movement of the second part relative to the first part by the same path length L. If such a displacement of the second part relative to the first part effects a shortening of the tumbler by L, then one can simultaneously succeed in the length of the counter-tumbler increasing by L—the sum of the lengths therefore remains constant.

For this purpose, the second part can be arranged axially within the fourth part with respect to the bore axis and be aligned with this. An outer-side portion (portion at the outer side) of the first part can moreover be aligned with an inner-side portion (portion at the inner side) of the third part.

Such results for example if the first part forms an inner, key-side end (end at the key side) of the tumbler (which also traces the coding of the key), the third part forms an outer end of the counter-tumbler, and a distance between the first part and the third part is kept constant when the fourth part is moved relative to the third part (for example is pressed inwards) and thereby the second part is moved relative to the first, or also if the second part is moved independently of the fourth part as is explained hereinafter.

For this purpose, a separation arrangement can be present between the first part and the second part, the separation arrangement being in physical contact with the first and third part and on account of which a plurality of possible separating gaps between the first part and the third part are defined—specifically at least where the separation arrangement is in contact with the first part and where the separation arrangement is in contact with the third part, and for example also within the separation arrangement. For the latter case, the separation arrangement includes, for example, several separation elements that are not connected to one another or only loosely (via a predetermined breaking location).

In embodiments with the separation arrangement, on the one hand the second and the fourth part can be aligned with one another and be displaceable together in the axial direction relative to the first and third part—at least inwards, and one the other hand an outer-side portion of the first part, the separation arrangement and an inner-side portion of the third part can be aligned with one another.

In particular, the second and the fourth part can be arranged radially within the inner-side portion of the third part (preferably of the complete third part), the separation arrangement and the outer-side portion of the first part, which surround the second and fourth part in a sleeve-like manner. In such embodiments, the separation arrangement for example can include one or preferably several rings, which in the latter case are loosely stacked upon one another or are connected to one another via a releasable connection (in particular predefined breakage location).

The actual separating gap between the tumbler and counter-tumbler is defined by the—displaceable, i.e. programmable—separating gap between the second and fourth part.

However, in embodiments, a programming that permits an arrangement of the second part relative to the fourth part at a distance to one another is possible, which allows several different codings to match the tumbler-counter-tumbler pair (several code stages), which can be applied for more complex locking systems with several keys opening a lock (so-called master key systems MKS). An applied programming tool can act directly upon the second part for displacing the second part without displacing the fourth part. For this purpose, the fourth part can include a through-opening, through which the programming tool can then also act upon the second part when the cylinder with the counter-tumbler is already assembled.

A programming tool of the type, which is described above by way of the first aspect, apart from the studs can also include at least one programming pin, which is held for example in the tool and during the programming, depending on the desired programming, projects so far beyond the stop that the second part is displaced with respect to the first part to the desired extent during the programming. Such a programming pin for example can guided in the tool in a manner in which it can be coaxially inserted into the bore, and for example can be led axially through an inner opening in the respective stud. For the programming, the programming pin can be brought into different positions relative to the stop surface of the tool, wherein this position is selected for example depending on the—known—coding of the key at the position of the corresponding tumbler-counter-tumbler pair.

That which follows potentially relates to both aspects of the invention:

Alternatively to the programming in the above-described manner with a direct action upon the second part, an MKS system can also be achieved by way of certain bores not being provided with tumbler-counter-tumbler pairs, or by way of some tumbler-counter-tumbler pairs being designed conventionally and being provided with one or more coding discs, so-called split pins.

In an embodiment, a key-side end of the respective tumbler, which is for tracing a key inserted into the locking cylinder, is formed by the first part, and a counter-tumbler-side end of the respective tumbler, which is for an interaction with the respectively assigned counter-tumbler, is formed by the second part.

In an embodiment, a stop for limiting the movement of the respective tumbler into the key opening is formed by the respective first part. By way of this, it can be possible to render an optical reading-out of the coding more difficult or even prevent this. The stop cooperates with a stop in the rotor bore for the tumbler, for the limitation of the movement.

In particular, one can envisage the first parts each including a section (for example a section which is annular in cross section), in which they fill out a cross section of a bore in the rotor, in which bore the respective tumbler is movably mounted. This can supplementarily or alternatively apply possibly (if present) to the third part and/or the separation arrangement. Of course, a play must still remain, by way of which the movability of the tumbler in the opening in the rotor is ensured.

It is also possible (additionally or alternatively) for the second parts to each have a section, in which they completely fill out a cross section of a bore in the rotor, in which bore the respective tumbler is movably mounted. This can lead to an increased mechanical stability and mechanical loadability of the locking cylinder and accordingly to an increased security of the locking cylinder. In this context, the second part can be T-shaped or mushroom-shaped for example. This possibility if need be does not apply to embodiments with the separation arrangement if this is present radially to the outside, as is preferred.

In an embodiment, a punch (also able to be called a shank) is formed by the second part and is inserted into an opening in the assigned first part, said opening being adapted to have a press fit with this punch. In particular, such a punch can be designed cylindrically and the opening in the assigned first part can be designed in a hollow-cylindrical manner.

The first part for example can be sleeve-like at least at the outer side.

The first and/or the second part for example can be rotationally symmetrical, in particular a turned part. The same optionally possibly applies to the third part and/or the fourth part and/or the separation arrangement.

The bores in the rotor and stator for example run radially with respect to the rotation axis of the rotor, which in particular favours the use of rotationally symmetrical parts. However, bore axes, which are skew with respect to the rotation axis, are also conceivable—depending on the arrangement of the coding on the key.

In an embodiment, an outer guide is formed by the first part and an inner guide is formed by the second part. However, it is also possible to provide this the other way around, so that an inner guide is formed by the first part and an outer guide by the second part. As the case may be, analogously the third part and the separation arrangement form an outer guide, and the second and the fourth part form an inner guide—or possibly vice versa.

The respective inner guide—outer guide pair on the one hand can ensure a movement of the two parts along the same axis on programming and on the other hand possibly (with an accordingly long design) a high press fit and thus a high mechanical stability of the connection of the two parts.

As already mentioned, in particular the first and the second part are connected to one another in a manner displaceable relative to one another in a press fit. The same can also supplementarily or alternatively apply to the third and fourth part with embodiments according to the second aspect.

A press fit is occasionally also called an interference fit. The two parts are connected to one another in such a firm manner by the press fit, that they retain their relative position even after years of use and after other typically occurring mechanical loading. On the other hand, on programming, the length of the tumbler can be adjusted by the mechanical forces which are applied with such programming. These forces are so large that the two parts which are situated in a press fit can be displaced relative to one another, which leads to the length adaption of the tumbler and thus to the programming.

In an embodiment, the first and/or third parts and/or the second and/or fourth parts and/or possibly the elements of the separation arrangement are manufactured from one of the materials

- bronze;
- brass;
- steel, in particular free cutting steel or spring steel strip or silver steel or sintered steel; or also
- ceramic;
- an artificial material (for example artificial stone, or also a polymer-based plastic with or without filler);
- another metal;
- in particular sintered metal or another sintered material.

In particular, the first, second and possibly third, fourth parts and/or parts of the separation arrangement can consist of the same or completely or partially different materials. Arbitrary combinations and permutations are possible.

In an embodiment, in particular one envisages

- the first/third part and the second/fourth part being manufactured from bronze; or
- the first/third part from bronze and the second/fourth part from brass; or
- the first/third part from silver steel and the second/fourth part from brass; or
- the first/third part from bronze and the second/fourth part from spring steel strip.

The specified material pairings are precisely the other way around in the case that the second/fourth part forms the radially outer-lying part with the press fit.

However, it is not only possible to manufacture the first and the second and/or the third and the fourth part of a metal. The first, second, third and/or fourth part for example can alternatively also be of plastic, for example of a polymer or of a polymer composite material.

In an embodiment, the locking cylinder includes a helical spring per tumbler-counter-tumbler pair. With the application of conventional counter-tumblers, such a counter-tumbler at its respective end, which is away from the key opening can include a recess for receiving the respective helical spring.

In an embodiment, the locking cylinder includes a housing, for example a sleeve, which encases the stator, and thereby each of the helical springs at their end that is away from the key opening abuts on an inner surface of the housing.

The invention moreover also relates to a device that includes one of the described locking cylinders as well as a tool. The tool can be used for programming the locking cylinder and be designed as is described in the present patent application. In particular, it can include a stop surface and at least one stud that projects out of the stop surface. It can also include several studs that project equally far out of the stop surface. The tool can be characterised in that it includes at least one stop surface and at least one stud that projects out of the stop surface, wherein the diameter and length of the at least one stud are adapted for a programming of the locking cylinder.

The method for programming a locking cylinder relates to a locking cylinder including a stator and a rotor that is rotatable in the stator and is with a key opening, into which a key can be inserted, and further including at least one tumbler that includes a first and a second part, which are connected to one another in a press fit. In the method, given a key inserted into the key opening, a locking-effective length of the tumbler is changed by way of pushing the first and the second part into one another or moving them apart, in particular by way of pushing them into one another, in particular by way of a tool, which engages from outside the locking cylinder, in particular when the key is completely inserted up to a key stop, so that each coding is positioned relative to the corresponding tumbler-counter-tumbler pair in the designated manner.

In embodiments, the tool includes a stop surface and a stud that projects out of the stop surface. The stud can also be called a rod and effects the insertion of the first and second part into one another. The stud can be solid stud. However, the stud can possibly be a hollow stud (or hollow rod).

Such a tool can permit a very precise programming, and it can be relatively simple to manufacture.

One can envisage the stop surface being plane. However, it can alternatively also have a curvature.

In an embodiment, the stud is led into the stator until the stop surface abuts on a counter-stop and a force is exerted upon the second part by the stud, by way of which force the pushing into one another is effected.

The mentioned counter-stop is mostly formed by a part of the locking cylinder. In particular, it can be formed by a housing that surrounds the stator, for example a sleeve, more precisely: by an outer surface of the housing. It is also possible to envisage the counter-stop being formed by the stator itself (more precisely: by an outer surface of the stator).

The mentioned force can be directed in the direction of the key. In particular, the force can be directed along a bore axis of the bore, in which the tumbler is located in the rotor.

One can envisage the stop surface having a curvature that is adapted to the curvature of the counter-stop.

In the case that the stator is encased by a housing (for example sleeve), (access)-openings can be provided in the housing, through which openings the stud can be led, so that the stud can be brought through the housing into the stator.

In an embodiment, a separating gap exists between the stator and the rotor and a length of the stud, which is measured from the stop surface, is dimensioned such that after the insertion of the stud into the stator up to the abutting of the stop surface on the counter-stop, the first and the second part are pushed into one another to such an extent that an end of the tumbler that is away from the key coincides with the separating gap.

In particular, in the case that a counter-tumbler is adjacent to the tumbler, the first and second part are pushed so far into one another that a separating gap formed between the tumbler and the counter-tumbler comes to lie at the separating gap between the stator and the rotor.

In particular, the tool acts upon the second part indirectly (by way of the stud pressing the counter-tumbler or a part of this against the tumbler) or directly (by way of pressing upon the second part), whilst an inner end of the first part abuts on the correspondingly coded key. If the separating gap between the tumbler and the counter-tumbler is thereby displaced up to the plane of the separating gap between the rotor and the stator, then the locking cylinder is programmed in this manner. Here, the tool in particular carries no information on the coding, and in contrast, this is transmitted from the key onto the locking cylinder with the described method.

A simple and precise programming (individualisation) of a locking cylinder, which is previously typically a generic locking cylinder, is rendered possible by way of the method. In particular, neither specifically adapted tools are required for the programming, nor does the cylinder need to be adapted. Under certain circumstances, the cylinder does not even need to be taken apart but can be adopted in a ready assembled manner as a generic cylinder and be adapted by way of the programming which is described here.

This method can also be applied to embodiments according to the second aspect, concerning which the counter-tumbler is of two parts, thus includes a third and a fourth part. The tool then for example acts upon the second part via the fourth part, i.e. the tool displaces the fourth part inwards relative to the first part—whilst for example the third part is prevented from being displaced inwards by way of the separation arrangement—and the fourth part displaces the second part inwards relative to the first part, which can be equivalent to a pushing of the second and first part into one another.

In an embodiment, concerning a locking cylinder according to the second aspect, a tool can be used, concerning which a programming pin acts directly upon the second part in order to bring this at a distance to the fourth part—this being in order to define several separating gaps so that an MKS can be created. Additionally, studs which act upon the fourth part in the manner described above can be present on the same tool or on a separate tool.

The two parts are connected to one another for example in a press fit before and after the programming and thus before and after the pushing of the first and second part into one another or their movement apart.

As already specified above, the detailed description is restricted to the case of the reduction of the locking-effective length by way of a (further) pushing of the first and second part into one another.

Basically, it is not necessary for a counter-tumbler assigned to the tumbler to be present on programming. The programming can also be carried out without a counter-tumbler. However, it can simplify the completion of the locking cylinder if, on programming, a counter-tumbler assigned to the tumbler is already provided in the locking cylinder and additionally possible yet also a spring.

The pushing of the first and second part into one another can already be effected by exerting a force acting in the direction of the key, so the first and the second part are pushed into one another by way of this. Here, in particular the first part can abut on the key.

Since the first and the second part are already led into one another (pushed into one another) before the programming, the mentioned pushing of the first and second part into one another on programming generally corresponds to a further pushing of the first and second part into one another.

In an embodiment, the locking cylinder with tumbler and assigned counter-tumbler includes a helical spring, which is assigned to the tumbler and to the counter-tumbler, wherein on pushing the first and the second part into one another, the stud extends through at least a part of the helical spring, in particular extends completely through the helical spring.

Typically, a locking cylinder of course includes several tumbler-counter-tumbler pairs. The described method can be applied without further ado to the case of locking cylinders with two or more tumblers, each with at least two parts.

It is possible to envisage the tumblers in a generic cylinder all being equally long.

Of course, it is possible to combine the embodiment variants described above with one or more of the other described embodiment variants, inasmuch as this is logically possible. This also relates to combinations of features that are described for the method, with features that are described for the locking cylinder and vice versa.

It is also important to note that tools of the above mentioned type do not need to have a programming-related coding. In other words: the tools for a locking cylinder to be programmed are the same, irrespective of the key for which (and by way of which) the locking cylinder is to be programmed.

Thus, for example, it is possible to keep a set of one or more tools on location (e.g. at a dealer), said set being suitable for the programming of a certain type of (generic) locking cylinders. Any arbitrary one of these locking cylinders can then be programmed with this tool set, for use with an arbitrary (of course basically suitable for the type of locking cylinder) key.

Alternatively however, the use of an at least partly coded tool is also possible. Such a tool can, for example, include a base body that forms a stop, and at least one programmed stud that projects beyond the base body to a programmable extent. The adjustment of such a stud can be effected manually, for example via an adjusting screw or electronically/in an automated manner.

The programming can be effected without a key, given the use of such a coded (programmable) tool. The information, which is used for the programming of the tool, in a manner known per se can be used separately also for the manufacture of the key by way of incorporating the respective coding.

In embodiments, it is also possible for the assembly of the locking cylinder not to be effected until the programming or after the programming, for example by way of the counter-tumblers—for example the two-part counter tumblers—and possibly the separation arrangements not being preassembled, but being inserted not until together with the corresponding stud of the tool, or being inserted after the—then programmable—tool has directly acted upon the second parts. In embodiments of the second aspect, one can also envisage the fourth parts or the second and fourth parts being incorporated at a later stage, for example on or directly before the programming.

Further embodiments and advantages are to be deduced from the dependent patent claims, the following description of embodiment examples and the figures.

BRIEF DESCRIPTION OF THE DRAWINGS

The subject-matter of the invention is hereinafter explained in more detail by way of embodiment examples and the attached drawings. There are shown in.

DETAILED DESCRIPTION OF THE INVENTION

Parts which are not essential for the understanding of the invention to some extent have not been represented. The described embodiment examples are exemplary for the subject-matter of the invention or they serve for its explanation and have no limiting effect.

Figure 1:
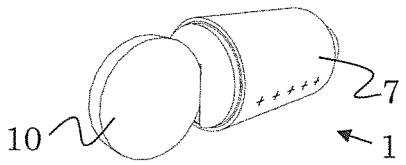
FIG. 1 shows a locking cylinder with an inserted key, perspectively.
Figure 2:
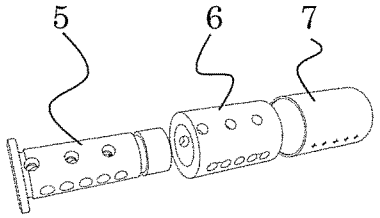
FIG. 2 shows the locking cylinder of FIG. 1, in an exploded representation, perspectively.

FIG. 1 in a perspective representation shows a locking cylinder 1 with an inserted key 10. FIG. 2 perspectively shows the locking cylinder of FIG. 1 in an exploded representation. The locking cylinder 1 includes a rotor 5 and a stator 6 as well as a sleeve 7. The locking cylinder 1 can include another housing instead of the sleeve 7, or the housing, apart from the sleeve, can yet include further parts which for example at least partly surround the sleeve, which is not represented in FIG. 1.

As already described further above, an at least two-part tumbler is suggested. One example of this is represented perspectively in FIGS. 3 and 4, in FIG. 4 in a sectioned manner.

In an otherwise known manner, the tumbler 2 together with a counter tumbler 3 (and with a helical spring 4, of which a part is received in a recess 3*a* of the counter-tumbler 3) as well as with a rotor 5 and stator 6 can permit the conventional closing and opening function of the locking cylinder. The rotor 5 is rotatable in the stator 6 and the rotor 5 is unlocked if, for all tumbler-counter-tumbler pairs, the separating gap T2, which is formed by them in each case coincides with the separating gap between the rotor 5 and the stator 6. The rotor is locked and cannot be rotated in the stator 6 as long as the separating gap T2 of at least one of the tumbler-counter-tumbler pairs lies somewhere else.

The tumbler 2 includes a first part 2*a* and a second part 2*b*, which have a press fit 2*p*. For example, the second (at the counter-tumbler side) part 2*b* can include a shank 2*i* and the first (at the key side) part 2*a* can include a guide 2*j* for the shank 2*i*, so that the two parts 2*a*, 2*b* are displaceable with respect to one another (whilst retaining the press fit).

Figure 3:
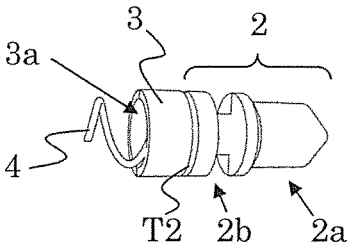
FIG. 3 shows a tumbler-counter-tumbler pair with a spring, perspectively.
Figure 4:
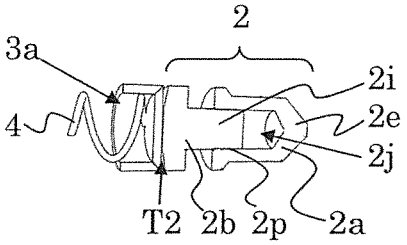
FIG. 4 shows the tumbler-counter-tumbler pair of FIG. 3, in section, perspectively.

As is represented in the example of FIGS. 3 and 4, the second part 2*b*, which is adjacent to the counter-tumbler, is designed in a T-shaped or mushroom-like manner and the first part 2*a* in a sleeve-like manner. The first part 2*a* includes an end 2*e*, by way of which a key inserted into the locking cylinder is traced.

FIGS. 5 to 15 perspectively show a locking cylinder 1 in a part section, for illustrating the locking cylinder 1 and its programming. Not all reference numerals are used in all of the figures, so as to achieve a clearer representation.

Figure 5:
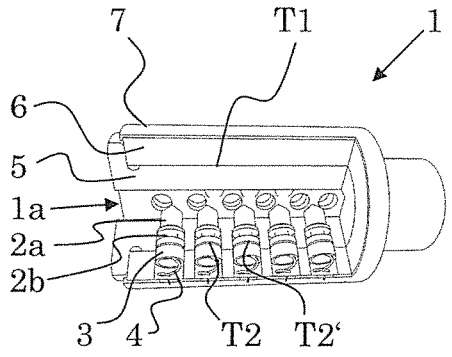
FIGS. 5-15 show the locking cylinder in part-section, perspectively, for illustrating the locking cylinder and its programming.

FIG. 5 illustrates a view into the inside of a not yet programmed, generic locking cylinder 1. The individual parts have already being previously described. The key opening is indicated at 1*a*. All five tumbler-counter-tumbler pairs still have the same length and are located at the same radial position. The initial situation can look the same in the case of locking cylinders for serrated locks. The length and alignment can be different for the different tumbler-counter-tumbler pairs for locking cylinders for reversible keys, which are more complex than that which is represented.

Moreover, it is only the case in which the locking cylinder is already preassembled with tumbler-counter-tumbler pairs as well as a spring 4 and sleeve 7, which is illustrated hereinafter. However, this does not necessarily need to be the case. For example, the sleeve 7 or also the sleeve 7 and counter-tumblers 3 (and springs 4) can alternatively be incorporated not until after the programming.

Figure 6:
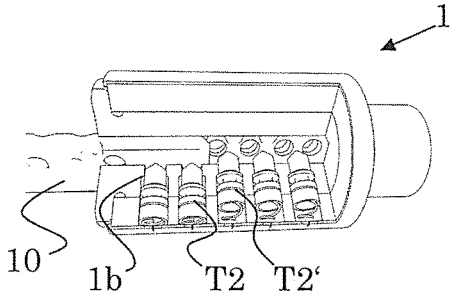

FIG. 6 illustrates the insertion of a key 10, for which (and by way of which) the locking cylinder 1 is to be programmed. The length of the tumblers 2 is still unchanged, but their radial position changes due to the insertion of the key 10, as is to be recognised at the separating gaps T2, T2'. The stop 1*b* of the bore is also visible in FIG. 6, and this stop has the effect that the tumblers 2 do not project too far into the key opening when the key 10 is not inserted (cf. FIG. 5).

Figure 7:
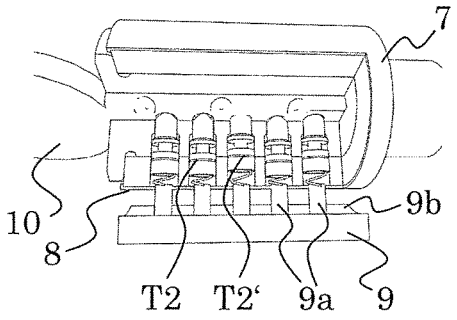

The key 10 is completely inserted in FIG. 7. The length of the tumblers 2 is still unchanged, but their radial (with regard to the axis of the rotor) position is now determined by the coding provided on the key 10, as can be recognised at the separating gaps T2, T2'.

A tool 9 for the programming (programming tool) is represented. It has several studs 9*a*, which are fastened on a base plate, by way of which a stop surface 9*b* is formed. A counter-stop 8 for the tool 9 is formed by the outer surface of the sleeve 7 in the represented example.

In FIG. 7, one also sees that the studs 9*a* of the tool are introduced through openings in the housing (here the sleeve 7) and that the helical springs then surround the studs. The openings in the housing have a smaller diameter than the helical springs, so that the latter can support themselves on the inner surface of the housing.

Figure 8:
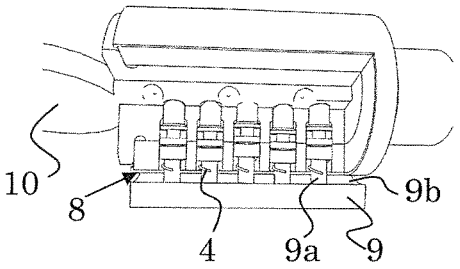

As is evident in FIG. 8, the studs 9*a* of the tool 9 are pushed through the sleeve 7 into the stator 6, wherein they each extend through the inside of one of the helical springs 4.

Figure 9:
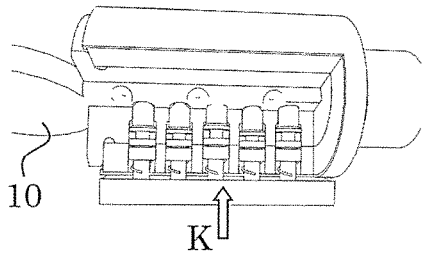

A force K, by way of which the parts 2*a* and 2*b* situated in a mutual press fit are pushed into one another is symbolised by the arrow K in FIG. 9. This leads to the shortening of the length of tumblers 2, which can be recognised in FIG. 9.

Figure 10:
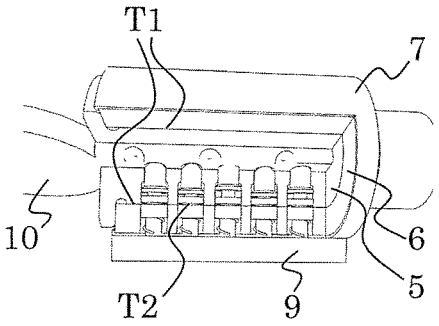

Stop surface 9*b* (of the tool 9) and the counter-stop 8 (of the locking cylinder 1) are in contact with one another in FIG. 10, so that a force for pushing the two parts 2*a*, 2*b* of the tumblers 2 into one another can no longer be exerted by way of the tool 9. The locking cylinder 1 now programmed and the rotor 5 is unlocked. As is evident from FIG. 10, all separating gaps T2 of the tumbler-counter-tumbler pairs coincide with the separating gap T1 between the rotor 5 and the stator 6.

Figure 11:
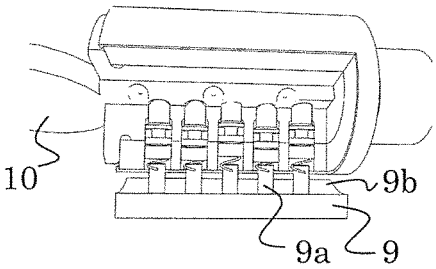
Figure 12:
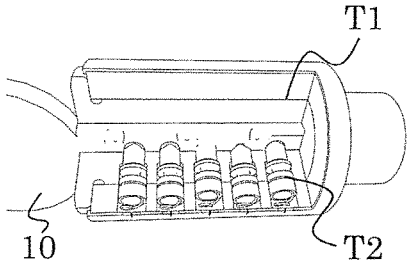

FIG. 11 shows the tool 9 being removed again, by way of the studs 9*a* being pulled out of the locking cylinder 1 again, and in FIG. 12 this tool it no longer represented.

Figure 13:
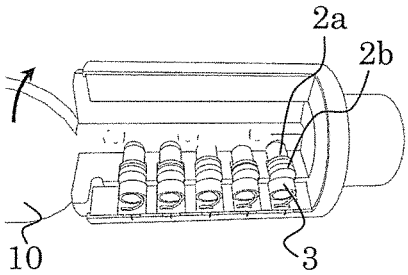
Figure 14:
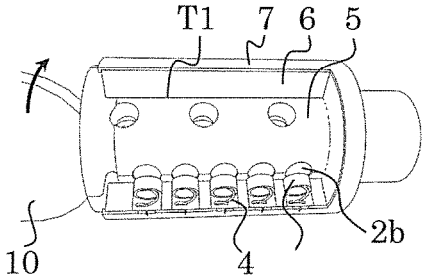
Figure 15:
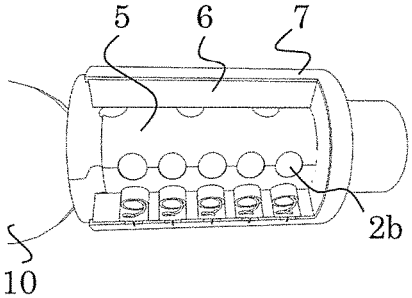

The situation when the key 10 has been rotated a little after the actual programming is illustrated in FIG. 13. The tumbler-counter-tumbler pairs are separated from one another. The key is rotated yet a little further in FIG. 14, and the rotor 5 is no longer represented in a sectioned manner. The key 10 is rotated yet somewhat further in FIG. 15.

As has become clear from above, the programming of the locking cylinder 1 can be effected in a simple but nevertheless precise manner, and the applied tool 9 can be one which is easily manufacturable.

With complex locking cylinders, for example with bores for the tumbler-counter-tumbler pairs, the bores running non-radially and at different angles and having different lengths, it can be necessary or make sense to use an individual tool for each tumbler-counter-tumbler pair or to use different tools for some of the tumbler-counter-tumbler pairs.

The tool or the tools thus carry no information on the coding of the locking cylinder. The coding of the locking cylinder is assumed by the key.

Figure 16:
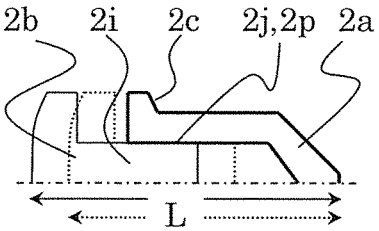
FIG. 16 shows a two-part tumbler, schematically, in section.

FIG. 16 schematically shows a two-part tumbler 2, in section. This tumbler 2 corresponds to that which is represented in FIGS. 3 and 4. The first part 2*a* is sleeve-like and forms (by way of an inner bore) an inner guide 2*j* for the shank 2*i* of the second part 2*b*, the second part being designed in a T-shaped or mushroom-shaped manner. The first part 2*a* further includes a stop 2*c*, by way of which (by way of interacting with the stop 1*b*, see FIG. 6) the tumbler 2 is held in its bore and too far a projecting of the tumbler 2 into the key opening 1*a* is prevented.

However, many further geometries of two-part tumblers 2 are also possible. The FIGS. 16 to 19 show a few examples.

For the sake of clarity, the first part 2*a* is represented by way of lines, which are represented in a broader manner than the second part 2*b* in FIGS. 16 to 19. The locking-effective length of the tumblers 2 is indicated at L.

A second position of the second part 2*b* as well as the corresponding (shortened) locking-effective length L as can be present for example after the programming of the locking cylinder is symbolised in FIG. 16 by way of dotted lines.

Figure 17:
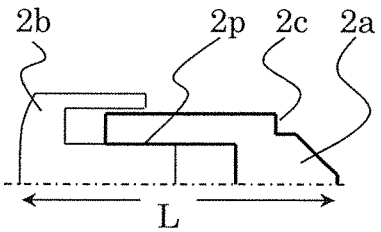
FIG. 17 show a two-part tumbler, schematically, in section.

The tumbler 2 of FIG. 17 is similar to that of FIG. 16. In this case however, the guidance of the second part 2*b* in the bore is improved, which however entails a more complicated manufacture of the second part 2*b*.

Figure 18:
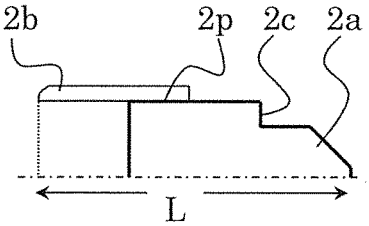
FIG. 18 show a two-part tumbler, schematically, in section.
Figure 19:
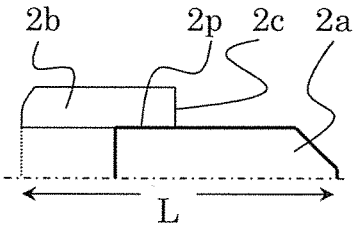
FIG. 19 show a two-part tumbler, schematically, in section.

In the examples of FIGS. 18 and 19, an inner guide is formed by the second part 2*b*, whilst a shank, which is guided in this, is formed by the first part 2*a*.

In the case of FIG. 18, the stop 2*c* is formed by the first part 2*a*, as with FIGS. 16 and 17. However, this entails a lower wall thickness of the sleeve-like second part 2*b*.

If the stop 2*c* is provided on the second part 2*b* as in FIG. 19, then the wall thickness of the sleeve-like second part 2*b* can be larger, so that the second part 2*b* can be quite robust. However, an optical readability of the coding can be simplified by way of this.

Some details have already been made concerning the material selection. For example, bronze can be selected for the first part 2*a* and brass for the second part 2*b*. Typical dimensions are a maximal diameter of the tumblers between 2 mm and 3 mm and a shank or guide diameter between 1 mm and 1.6 mm, with a (diameter-related) interference for the press fit of between 0.015 mm and 0.04. Other materials and dimensions are conceivable.

Figure 20:
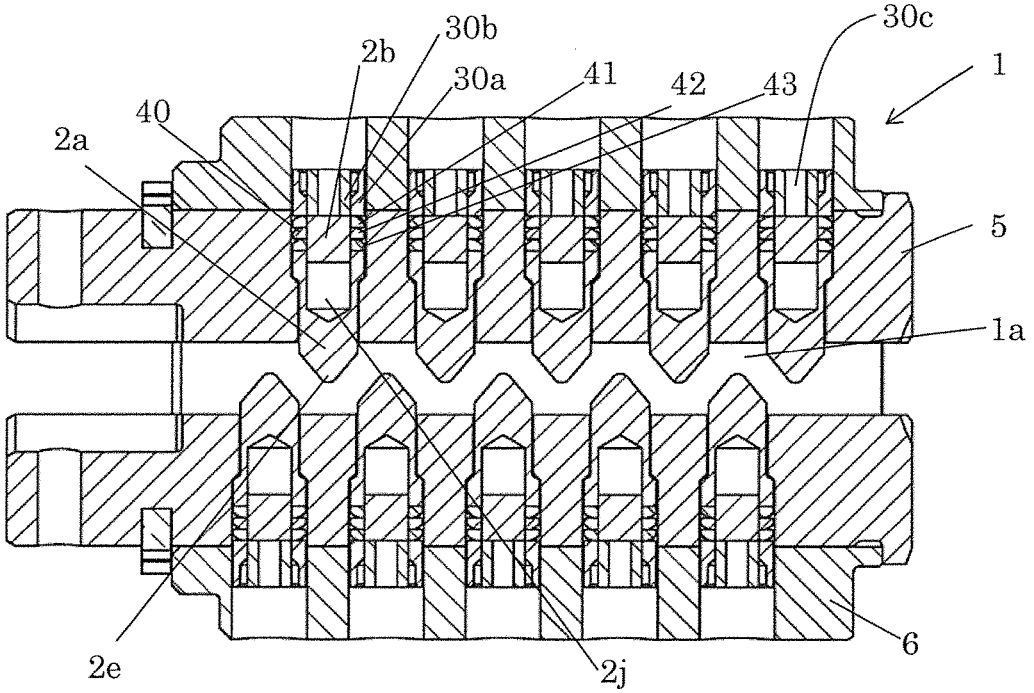
FIG. 20 show a further embodiment of a generic locking cylinder, in section.

An example of a locking cylinder 1 according to the first and the second aspect is represented in FIG. 20, in which, as in the following figures, the rotor 5 and the stator 6 with tumblers 2 and counter-tumblers 30 are represented in section in the initial position (in which the bores of the rotor and the stator are aligned with one another and in which the key can be inserted or also withdrawn), wherein the housing, on which for example (not drawn in these figures) springs acting upon the counter-tumbler at the outer side support themselves, is not drawn for the sake of simplicity. As explained by way of the above examples, such a housing can include openings for the studs of the tool.

Figure 28:
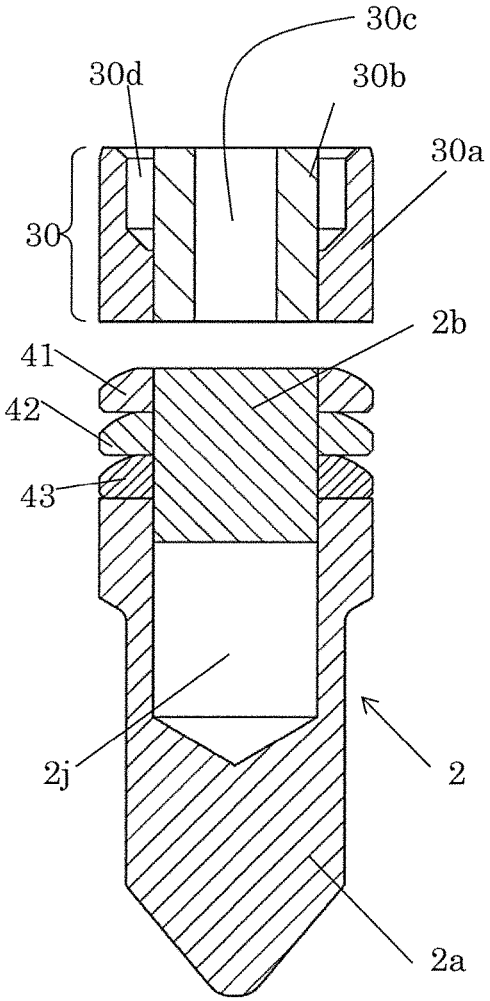
FIGS. 28 and 29 are each a representation of a programmable tumbler-counter-tumbler pair with a separation arrangement, for a locking cylinder according to one of the FIGS. 20-27.
Figure 29:
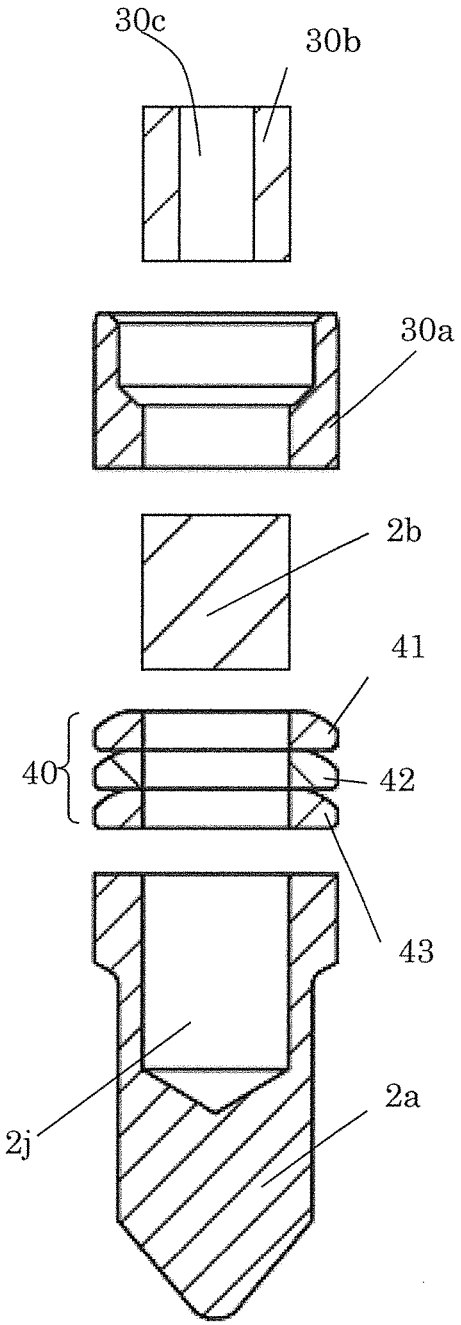

The generic, programmable locking cylinder is drawn in the initial, unprogrammed configuration and without a key shank inserted into the keyway 1*a* is shown in FIG. 20. FIGS. 28 and 29 each show a tumbler-counter-tumbler pair with a separation arrangement for a locking cylinder as is represented in FIG. 20 and the subsequent figures, FIG. 29 in an exploded representation (wherein the elements 41, 42, 43 of the separation arrangement 40 are drawn close together, although they can be designed, for example, as separate elements).

In contrast to the previously described embodiments of the first aspect, apart from the two-part tumblers 2, the locking cylinder 1 also includes two-part counter-tumblers 30, which one can see particularly well in FIGS. 28 and 29.

The programmable tumbler-counter-tumbler pairs (in FIG. 20 all represented ten pairs are represented as programmable pairs; however combinations with conventional tumbler-counter-tumbler pairs are also conceivable) are constructed as follows: the first part 2*a* of the tumbler includes the inner end 2*e*, which projects into the keyway 1*a*. At the outer side, it includes a sleeve-like section, which forms an outwardly open opening and which forms a guide 2*j* for the second part 2*b*. The second part is designed as an inner part, which is guidable in the inside of the sleeve-like section and which in the initial configuration is only inserted with its inner end into the guide 2*j*. The second part 2*b* is fixed relative to the first part 2*a* since the first part and the second part in their dimensioning are matched to one another such that a press fit results.

The counter-tumblers 30 also include a third, outer part 30*a* and a fourth, inner part 30*b*. The fourth part 30*b* is guided in the third part 30*a*, which for this purpose is constructed in a sleeve-like manner, with a continuous opening. The dimensioning of this continuous opening is matched to the outer dimensioning of the fourth part such that a press fit likewise results between these parts. The continuous opening of the third part 30*a* can be extended to the outside, so that an opening 30*d* (a peripheral groove in the arrangement according to FIG. 28), which is delimited to the bottom and into which a helical spring of the previously described type can engage results, wherein the helical spring at the outer side abuts on an inner surface of a housing surrounding the stator and likewise being of the already previously described type.

In the represented examples, the fourth part itself is likewise designed in a sleeve-like manner with an inner opening 30*c*, which is continuous in the direction of the bore axis. This design is optional and in embodiments serves for the purpose of programming a master key system (MKS), which is explained in yet more detail hereinafter.

A separation arrangement 40 is present between the first part 2*a* and the third part 30*a*. This includes a plurality of separation elements 41, 42, 43, between which a separating gap is formed in each case. The thickness of the separation elements (measured in the direction of the bore axis) corresponds to the difference of two adjacent possible coding depths of coding bores of the key, the difference being provided in the complete locking system. Here, the key is designed a flat key/reversible key. If the invention is embodied by a serrated key, then the thickness corresponds to the distance of two adjacent possible coding steps of the serrated profile.

The separation elements can be fixed relative to the second part 2*b* as well as relative to the fourth part 30*b*, here likewise by way of a press fit, by way of them including a continuous opening, which, with regard to its inner diameter, is accordingly matched to the outer diameter of the first and fourth part. Accordingly, the separation elements can be counted as belonging the tumbler or to the counter tumbler after the programming.

A fixation of the separation elements relative to the tumbler or counter-tumbler is otherwise not necessary at all. In contrast, these can also be arranged for example in a loose manner relative to the tumbler/counter-tumbler, since their function lies in the definition of the distance between the first and the third part during the programming and the position of the separation elements relative to the tumbler and counter-tumbler is already defined by the arrangement.

In the initial configuration, all separation elements 41-43 are fixed on the second part 2*b*.

In the represented embodiment example, the separation elements 41, 42, 43 are formed as holed discs (washers). Alternatively, they can also initially form a single-piece element with predefined breakage locations corresponding to the separating gaps. Other geometries, for example slotted rings are possible and an inside-outside interchanging (i.e. the second and the fourth part are each sleeve-like, and the first and the second part as well as the separation arrangement are led in these sleeves) is likewise not ruled out, wherein in the latter case openings in the housing (not represented in FIG. 20 *ff.*) for the studs of the tool are possibly to be adapted and can be designed for example in a half-moon like manner.

Figure 21:
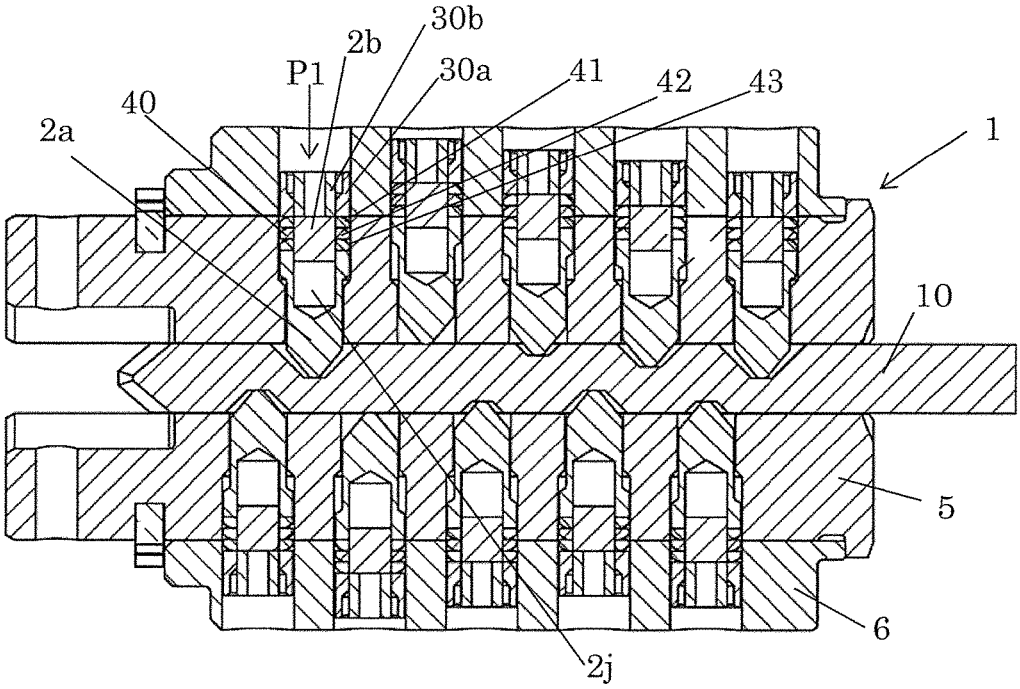
FIG. 21 show the locking cylinder according to FIG. 20, after inserting a coded key.

FIG. 21 shows the locking cylinder according to FIG. 20 after inserting a key 10. The tumbler-counter-tumbler pairs are displaced outward to a different extent in accordance with the coding of the key, counter to the spring force of the springs, which are not shown. In this configuration, the locking cylinder is ready to be programmed according to the coding of the inserted key 10.

Figure 22:
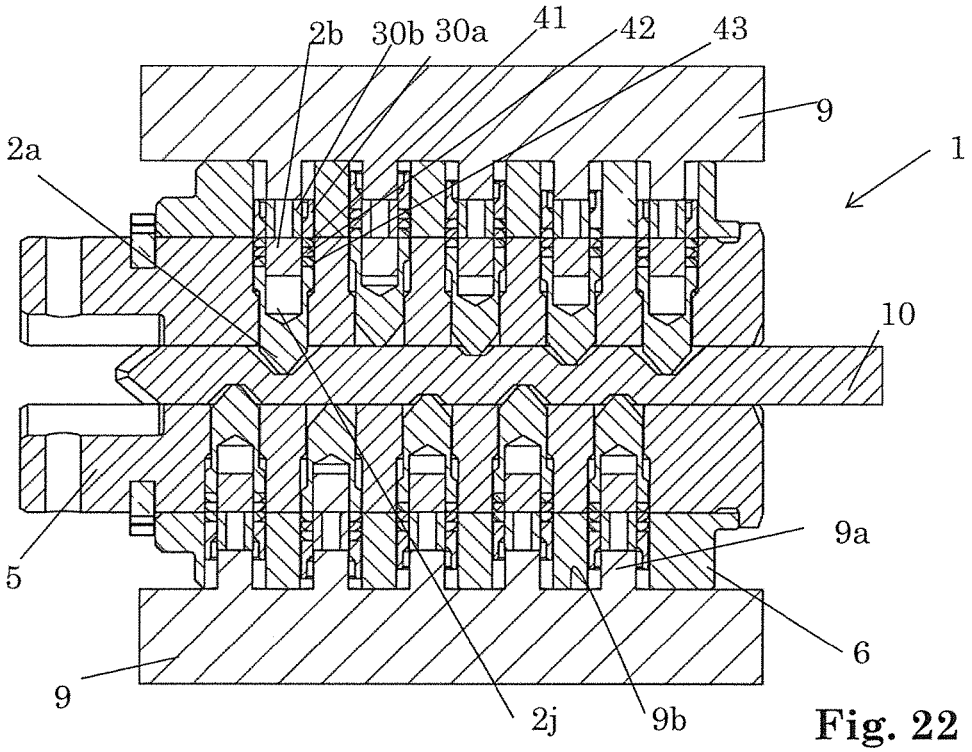
FIG. 22 show the locking cylinder according to FIGS. 20 and 21 during the programming.

FIG. 22 shows the programming. A tool 9, which is designed analogously to the tool described by way of the first aspect and which has a stud 9*a* is positioned relative to the locking cylinder such that the stud 9*a* project into the bore, and is then pressed against the cylinder until the stop surface 9*b* abuts on a corresponding stop surface of the cylinder (in FIG. 22 formed by the outer surface of the stator; alternatively also by a surface of the housing which is not drawn).

The stud 9*a* act upon the fourth part, which is pressed in further relative to the bore, inasmuch as it is not already seated so deeply in the bore that the respective stud 9*a* does not reach it at all—this being due to a particularly deep coding bore of the key (as in FIG. 21 at the position P1). The fourth part 30*b* is displaced inwards relative to the third part by way of the pressing force and thereby presses the second part inwards relative to the first part. Here, the first and the second part are prevented from being displaced inwards due to the abutting on the key 10 or on the separation arrangement 40.

The length of the studs 9*a* is matched to the dimension of the fourth part such that on pressing in the tool up to the stop, the separating gap between the second and the fourth part—said separating gap forming the separating gap between the tumbler and counter tumbler—is aligned with the separating gap between the rotor and the stator, for all tumbler-counter-tumbler pairs, which can be clearly seen in FIG. 22. Since a separating gap is present between the separation arrangement 40 and the first 2*a* or the third part 30*b* or between elements 41, 42, 42 of the separation arrangement, at each coding depth of the coding bore, then this is a sufficient as well as necessary condition for the rotor 5 to be able to be rotated relative to the stator 6 when the key 10 is inserted.

Two tools 9 are drawn in FIG. 22, one for each of the represented coding rows. However, it is of course also possible to work with only one tool even with the presence of several rows, which is mostly the case for a flat key; the tool is then sequentially applied for the programming of the various rows.

For the engagement of studs of the tool 9, the housing (for example sleeve; not drawn in FIG. 20-27) which surrounds the sleeve includes one opening per bore in the stator, the opening being aligned with this bore and having a smaller diameter than the bore but a larger diameter than the respective stud of the tool, so that a stop surface for the helical spring is formed, and the stud can nevertheless act through this opening upon the fourth part 30*b*. The diameter of the stud is possibly larger than the diameter of the inner opening 30*c* of the fourth part 30*b*, but it is smaller than the diameter of the helical spring and of the fourth part 30*b*

Figure 23:
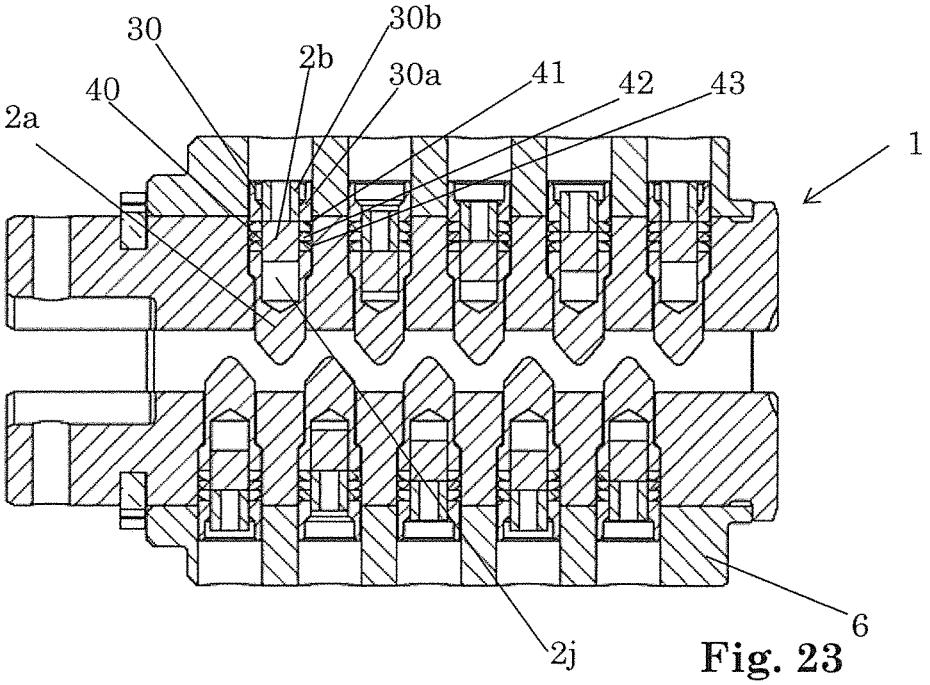
FIG. 23 show the locking cylinder according to FIG. 20-22 after the programming.

FIG. 23 shows the programmed locking cylinder after removal of the key 10. The key 10 or a key, which is constructionally the same, must be inserted so that all separating gaps between the second and fourth element are accordingly positioned, so that the locking cylinder can be actuated by way of rotating the rotor 5.

It is often a requirement for the locking cylinder to be able to be actuated by way of several different keys, in order to provide different access authorisations, for example for a main entrance and apartment doors, for a master key or more complex different stages of hierarchy. For this purpose, in the case of purely mechanical locks, at least some of the tumbler-counter-tumbler pairs must have several separating gaps so as to be able to be actuated by different keys, and/or tumbler-counter-tumbler pairs must be completely omitted.

Systems with locking cylinders, which can be opened by several different keys, are called MKS systems here. Two possibilities that—apart from the trivial solution of simply omitting tumbler-counter-tumbler pairs—enable locking cylinders according to the invention to also be suitable to MKS systems, are represented hereinafter by way of FIGS. 24-27.

Figure 24:
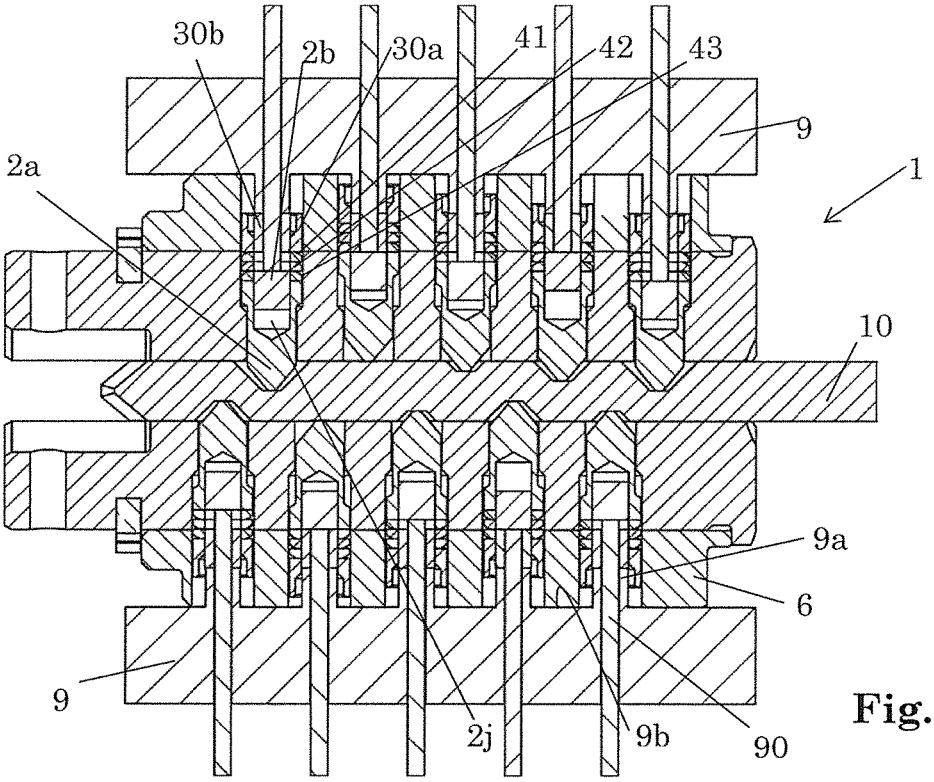
FIG. 24 show the locking cylinder according to FIG. 20 during the programming with a tool that permits the programming into a locking cylinder, which can be opened with different keys.
Figure 25:
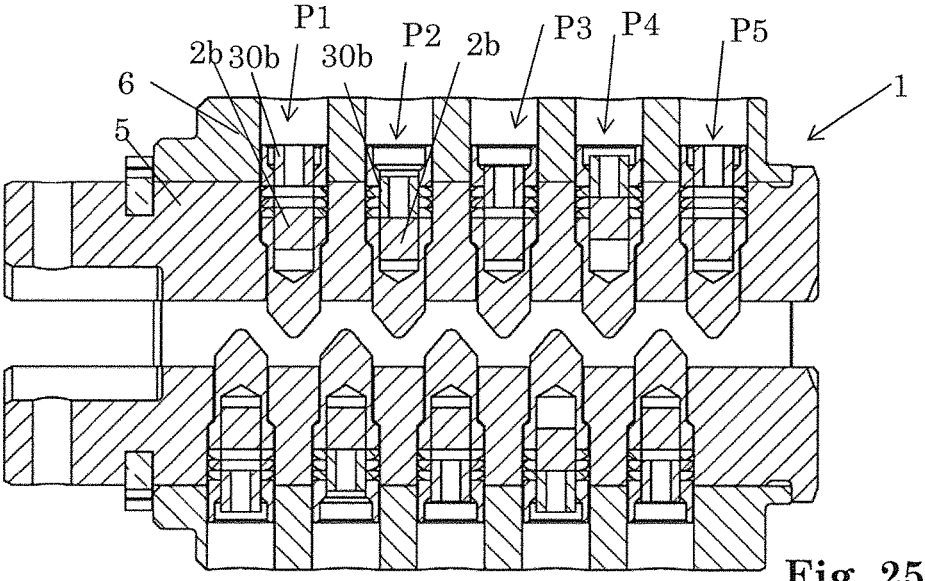
FIG. 25 show the locking cylinder according to FIG. 20 after the programming according to FIG. 24.

FIG. 24 shows a locking cylinder, which, with regard to the initial configuration corresponds to that of FIG. 20, during the programming in a set-up analogously to FIG. 22. However, the tool 9 is constructed in a more complex manner in comparison to the embodiment according to FIG. 22. Apart from the studs 9*a*, it includes a plurality of programming pins 90, which are led through the tool coaxially with the tumbler and counter-tumbler bore and can be led through the inner opening 30*c* of the fourth part 30*b* as well as through the inner opening of the separation arrangement 40, and can therefore act directly upon the second part 2*b*.

In the represented embodiment, the tool 9 is equipped with one programming pin 90 per 9*a*, which however is optional. If the position, at which the tumbler—counter-tumbler pair is to have several separating gaps is known from the very beginning, then an equipping only at these positions can also be present. As a further alternative, the functions of the studs 9*a* and of the programming pins 90 can also be implemented by two different tools, which are applied one after the other, or the same tool can be applied twice in a successive manner, once without programming pins and once with programming pins.

The programming pins 90 can be adjusted (relative to the body and the studs 9*a* of the tool in the drawn embodiment) such that they project differently far into the bores and on guiding the tool up to the stop 9*b* push the second parts 2*b* inwards to a different extent. In particular, they can push a second part 2*b* further inwards than it was pushed inwards by the fourth part 30*b* by way of the action of the stud 9*a*, so that the second part lies at a defined distance to the fourth part in this case. This can also be easily seen in FIG. 25, which shows the situation after the removal of the tool 9 and the withdrawal of the key.

In the shown illustrative example, the distance at the position P1 for example is two units (a unit is the difference between two adjacent, possible and defined coding depths of coding bores of the key, corresponding to the distance of two adjacent separating gaps of the separation arrangement 40, here corresponding to the thickness of one of the separation elements 41, 42, 43), at the position P5 is three units, at the position P3 is one unit, and at the positions P2 and P4 no distance at all is present.

There are several possible separating gaps between the tumbler and counter-tumbler, where a distance between the second and the fourth part is programmed in; the separation elements in the intermediate space can selectively remain in the bore of the tumbler or counter-tumbler when the rotor is rotated relative to the stator—similarly to a so-called split pin as is known in conventional mechanical locking systems with MKS function.

The number of separating gaps per tumbler-counter-tumbler pair is a+1, wherein a is the distance, measured in mentioned units.

A locking system which includes at least one tumbler-counter-tumbler pair, which has a plurality of separating gaps, as is demanded for locking systems with an MKS system, is rendered possible by way of the programming means—here programming pins 90—that act directly upon the second part.

Figure 26:
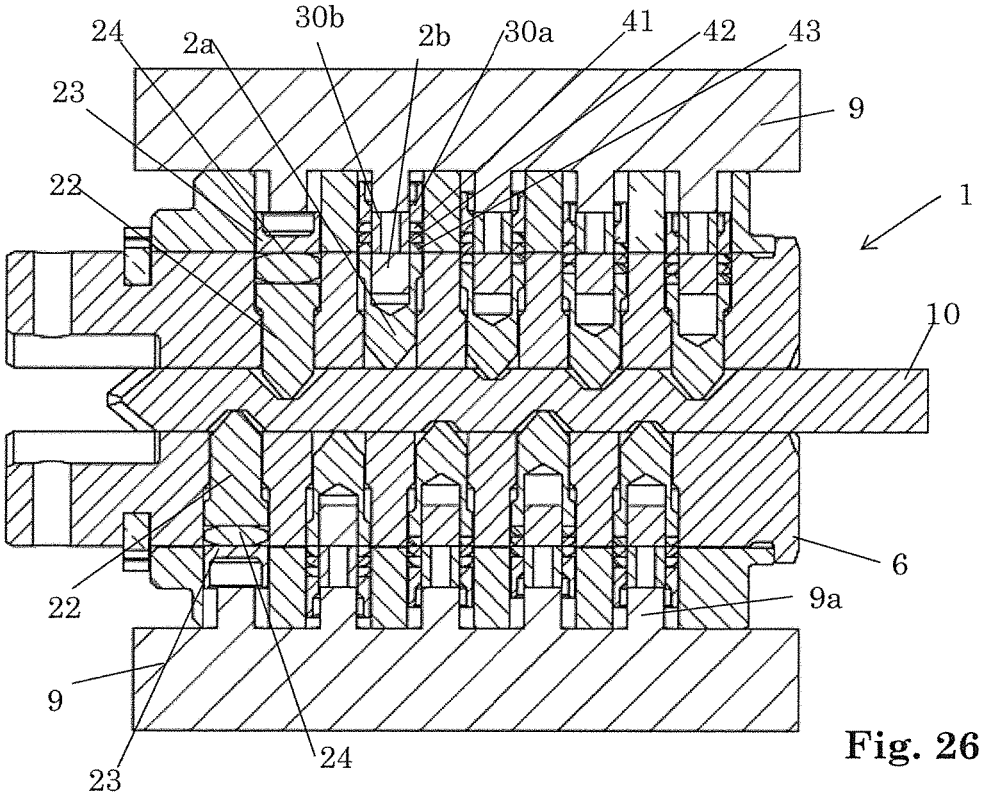
FIG. 26 show a locking cylinder, which is an alternative to the locking cylinder according to FIG. 20, during the programming.
Figure 27:
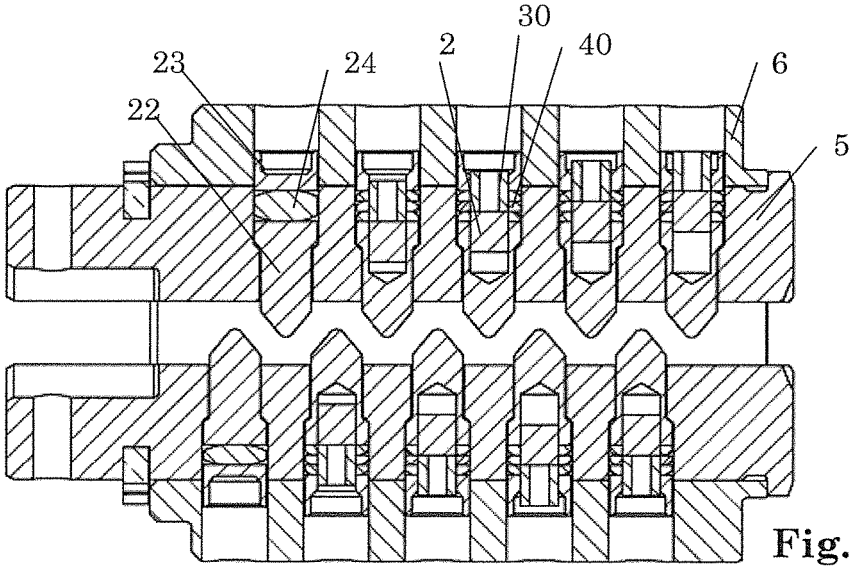
FIG. 27 show the locking cylinder according to FIG. 26 after the programming.

FIG. 26 shows an approach, which is alternative to this and concerning which individual ones of the tumbler-counter-tumbler pairs—in the represented example the two pairs, which are at the very inside with respect to the key opening, i.e. to the very left in the representation of FIG. 26—are not programmable, but are designed as a pair of conventional tumblers 22 and counter-tumblers 23, with a split pin 24 therebetween. The split pin 24—or perhaps several split pins per bore pair—can be shaped with different thicknesses as is known per se and thus have different separating gaps corresponding to defined coding depths of the corresponding bore on the key. The construction and programming of the remaining tumbler-counter-tumbler pairs is as described by way of FIG. 20-23. FIG. 27 shows the locking cylinder after the programming.

In contrast to the already described embodiment examples, the selection of the coding of the key for a locking cylinder according to FIGS. 26 and 27 is not freely selectable. In contrast, the codings are predefined at the positions of the conventional tumbler-counter-tumbler pairs, which are provided by the cylinder manufacturer, wherein as is known from MKS system, several different codings match—depending on the selected tumbler, counter-tumbler and split pin(s).

The conventional MKS tumbler-counter-tumbler pairs can optionally be identical with all locking cylinders of a series of locking cylinders and thus likewise be able to be delivered as generic cylinders, but provide an MKS function due to their design.

Systems with the MKS function according to the principle of the FIGS. 26 and 27 in particular have an MKS function and nevertheless can be programmed with the simplest of tools; they therefore combine the MKS functionality of known systems with the programmability by way of the simplest of tools according to the embodiment of FIGS. 1-23.

In all represented embodiment examples of the first and second aspect, a press fit has been described for the fixation of the first part relative to the second part and possibly for the fixation of the third part relative to the fourth part. This however is not necessary. Other fixation mechanisms, which permit the programming of the type described here, are conceivable for all embodiments of the first and/or second aspect.

A first alternative to the press fit (of a non-positive connection) for example is a latching system, according to which the second part can latch relative to the first part and/or possibly the fourth part relative to the third part, at a plurality of defined positions. For example, the second part can include a small peripheral rib or at least one latching projection, which can latch into one of several corresponding grooves or latching openings of the first part. This analogously optionally applies to the fourth part and the third part.

A second alternative for the press fit is bonding, wherein a small quality of adhesive is then incorporated between the first and the second part and/or between the third and the fourth part, before the programming, and wherein the tool is not removed until after the curing of the adhesive.

Other material connections such as welding—for example by way a current conducted through the counter-tumbler and tumbler—or soldering, are also not to be ruled out. Likewise not ruled out are other (apart from the latching system) positive connections, for example connected by way of an activation (for example rotation of the second/fourth element in the manner of a bayonet connection).

The invention claimed is:

1. A locking cylinder, comprising a stator and a rotor, which is rotatable in the stator and which includes a key opening into which a key can be inserted, as well as comprising a plurality of tumbler-counter-tumbler pairs, which are displaceably mounted in bores in the rotor and stator respectively, wherein at least one of the tumblers comprises a first part and a second part that can be brought into different positions relative to one another and fixed in these positions, and at least the associated counter-tumbler comprises a third part and a fourth part, which can be brought into different positions relative to one another and fixed in these positions, wherein a locking-effective total length of the tumbler along a bore axis depends on the relative position of the first and second part, and a locking-effective total length of the counter-tumbler along the bore axis depends on the relative position of the third and the fourth part.

2. The locking cylinder according to claim 1, wherein the shaping of the first, second, third and fourth parts and their arrangement relative to one another in an initial position of the rotor relative to the stator is such that a movement of the fourth part relative to the third part by a path length effects a movement of the second part relative to the first part by said path length.

3. The locking cylinder according to claim 1, comprising an access that is arranged such that a tool can act upon at least the fourth part from outside the locking cylinder and displace at least the fourth part relative to the third part.

4. The locking cylinder according to claim 1, comprising a separation arrangement that is arranged between the first part and the third part, wherein the first part forms an inner, key-side end of the tumbler, wherein the third part forms an outer end of the counter-tumbler, wherein when the bore in the rotor, in which bore the tumbler is mounted and the bore in the stator, in which bore the counter-tumbler is mounted are aligned with one another and the counter-tumbler is pressed inwards by a spring force, then the separation arrangement is in physical contact with the third part and abuts on the first part, and thereby a distance between the inner, key-side end of the tumbler and the outer end of the counter-tumbler is defined by the first part, the third part and the separation arrangement and is independent of the relative positions of the second part and the fourth part.

5. The locking cylinder according to claim 4, wherein the separation arrangement comprises a plurality of defined separating gaps.

6. The locking cylinder according to claim 4, wherein an outer-side portion of the first part, the separation arrangement and an inner-side portion of the third part are aligned with one another with respect to the bore axis, and wherein the second part and the fourth part are aligned with one another.

7. The locking cylinder according to claim 1, wherein all tumbler-counter-tumbler pairs have a same total length, in order to prevent a reading-out.

8. The locking cylinder according to claim 1, wherein, with respect to the bore axis, the second part is arranged radially within a sleeve-like portion of the first part and the fourth part is arranged radially within a sleeve-like portion of the third part.

9. The locking cylinder according to claim 1, wherein the fourth part comprises a through-opening, through which a tool engaging from outside the locking cylinder can act directly upon the second part, in order to bring the second and the fourth part at a defined distance to one another for the definition of a plurality of separating gaps.

10. A locking cylinder according to claim 1, wherein the locking cylinder is programmable by way of a tool that exerts a pushing force upon the counter-tumbler or directly upon the tumbler, in order to displace the second part relative to the first part, while a key with a desired coding is inserted into the cylinder and forms an inner-side stop for the tumbler, said stop being dependent on the coding.

11. The locking cylinder according to claim 10, further comprising an access for the tool.

12. The locking cylinder according to claim 1, wherein the first part and the second part are connected to one another in a press fit.

13. The locking cylinder according to claim 1, wherein a locking-effective length of the tumbler can be reduced by way of pushing the first and the second part into one another.

14. The locking cylinder according to claim 1, wherein a key-side end of the tumbler, which is for tracing a key inserted into the locking cylinder, is formed by the first part, and a counter-tumbler-side end of the tumbler, which is for an interaction with the respectively assigned counter-tumbler, is formed by the second part.

15. The locking cylinder according to claim 1, wherein a stop for limiting a movement of the tumbler into the key opening is formed by the first part.

16. The locking cylinder according to claim 1, wherein a punch is formed by the second part, said punch being inserted into an opening in the assigned first part, said opening being adapted to said punch in a press fit.

17. The locking cylinder according to claim 1, wherein the first parts and the second parts are each manufactured from one of the materials:

bronze;

brass;

free cutting steel or spring steel strip or silver steel ceramic;

an artificial material.

18. The locking cylinder according to claim 1, comprising the combination of a plurality of programmable tumbler-counter-tumbler pairs, with which at least the tumbler comprises the first part and the second part that can be brought into different positions relative to one another and can be fixed in these different positions, with at least one MKS tumbler-counter-tumbler pair, with which the tumbler and the counter-tumbler each have a predefined length and with which at least one split pin is present between the tumbler and the counter-tumbler.

19. A device, said device comprising a locking cylinder according to claim 1 as well as a tool, said tool comprising a stop surface and at least one stud that projects out of the stop surface.

20. The device according to claim 19, wherein the tool comprises several studs that project equally far out of the stop surface.

21. The locking cylinder according to claim 17, wherein the first part is manufactured from bronze and the second part from bronze; or the first part is manufactured from bronze and the second part is manufactured from brass; or the first part is manufactured from silver steel and the second part is manufactured from brass; or the first part is manufactured from bronze and the second part is manufactured from spring steel strip.

* * * * *